US006821014B2

(12) United States Patent
Hiranuma et al.

(10) Patent No.: US 6,821,014 B2
(45) Date of Patent: Nov. 23, 2004

(54) ROTATING-TYPE BEZEL APPARATUS AND PORTABLE TIMEPIECE HAVING ROTATING-TYPE BEZEL APPARATUS

(75) Inventors: Haruki Hiranuma, Chiba (JP); Hisamitsu Yoshikawa, Chiba (JP); Nobukazu Oomori, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 10/320,097

(22) Filed: Dec. 16, 2002

(65) Prior Publication Data

US 2003/0123332 A1 Jul. 3, 2003

(30) Foreign Application Priority Data

Dec. 28, 2001 (JP) ..... 2001-400459

(51) Int. Cl.[7] ..... G04B 37/00; G04B 39/00
(52) U.S. Cl. ..... 368/295; 368/294
(58) Field of Search ..... 368/294–295

(56) References Cited

U.S. PATENT DOCUMENTS 3,271,945 A * 9/1966 Anderson ..... 368/22
3,520,129 A * 7/1970 Schneider ..... 368/295
4,347,594 A * 8/1982 Tschanz ..... 368/21
4,420,264 A * 12/1983 Murata ..... 368/223
5,319,617 A * 6/1994 Sonoda ..... 368/294
5,490,123 A * 2/1996 Biver ..... 368/295
6,010,241 A * 1/2000 Bulgari ..... 368/190
6,134,189 A * 10/2000 Carrard ..... 368/69
6,200,019 B1 * 3/2001 Latini ..... 368/289
6,599,009 B2 * 7/2003 Terasawa et al. ..... 368/295

FOREIGN PATENT DOCUMENTS

CH 573386 A1 * 12/1993 ..... 368/295
JP 4361192 A * 12/1992 ..... 368/295

* cited by examiner

*Primary Examiner*—Randy W. Gibson
*Assistant Examiner*—Michael L. Lindinger
(74) *Attorney, Agent, or Firm*—Adams & Wilks

(57) ABSTRACT

A rotating-type bezel apparatus has a case body and a bezel rotatably mounted on the case body and having alternately spaced recesses and projections. A first member is mounted on the case body and has an end portion elastically engageable with surface portions of the recesses and projections of the bezel to impart a click feel to the bezel during rotational movement thereof. A second member is movably mounted on the case body for movement between a first position and a second position. In the first position, the second member engages the first member to prevent a release of an elastic engagement between the front end portion of the main body of the first member and the surface portions of one recess and the two projections on either side of the one recess of the bezel. In the second position, the second member does not engage the first member and thereby permits the release of the elastic ingagement between the front end portion of the main body of the second member and the surface portions of the one recess and the two projections on either side of the one recess of the bezel.

20 Claims, 12 Drawing Sheets

ROTATING-TYPE BEZEL APPARATUS AND PORTABLE TIMEPIECE HAVING ROTATING-TYPE BEZEL APPARATUS

BACKGROUND OF THE INVENTION

The present invention relates to a rotating-type bezel apparatus suitable for use in a portable timepiece having a rotating bezel such as a diver's watch, and to a portable timepiece having the rotating type bezel apparatus.

There is known a portable timepiece having a rotating bezel such as a diver's watch having a bezel mounted to a case body rotatably around a central axis line of the case body and having recesses and projections at constant angular intervals along a peripheral direction thereof, and a leaf spring mounted to the case body elastically engageably to a recess of the recesses and projections of the bezel at a front end portion thereof to give a click feeling in rotating the bezel. According to a portable timepiece of this kind, the bezel is attached with a graduation in the peripheral direction, for example, at start of diving, the bezel is rotated to set an original point or a start point of the graduation of the bezel to a hand (for example, minute hand) position at a time point of starting to dive and the diving is started. In this case, a diving period of time can directly be recognized optically by reading the position of the minute hand of the timepiece or the like by the graduation of the bezel.

However, according to a conventional portable timepiece having a rotating bezel of this kind, when the bezel is exerted with an expected external force, there is a concern of rotating the bezel by releasing engagement between the recess of the bezel and the front end portion of the spring by pushing out the front end portion of the leaf spring from the recess by a side wall of the recess of the bezel. As a result, there is a concern that the diving period of time cannot accurately be known in diving.

The invention has been carried out in view of the above-described various points and it is an object thereof to provide a rotating type bezel apparatus and a portable timepiece having the rotating bezel apparatus in which there is not actually a concern of rotating the bezel unexpectedly after the bezel has been positioned.

SUMMARY OF THE INVENTION

In order to achieve the above-described object, a rotating type bezel apparatus of the invention includes a case body, a bezel mounted to the case body rotatably around a central axis line of the case body and having recesses and projections at regular angular intervals along a peripheral direction, a spring mounted to the case body to be elastically engaged with the recesses and projections of the bezel at a front end portion thereof to give a click feeling in rotating the bezel, and a stopper mounted to the case body movably between an engagement release prohibiting position for prohibiting to release engagement between the front end portion of the spring and the recesses and projections of the bezel and an engagement release permitting position for permitting to release the engagement.

According to the rotating type bezel apparatus of the invention, there is provided 'a spring mounted to the case body to be elastically engaged with the recesses and projections of the bezel at a front end portion thereof' and therefore, in rotating the bezel, a click feeling can naturally be given, particularly, there is provided 'a stopper mounted to the case body movably between an engagement release prohibiting position for prohibiting to release engagement between the front end portion of the spring and the recesses and projections of the bezel and an engagement release permitting position for permitting to release the engagement' and therefore, by setting the stopper to the engagement release permitting position, rotating the bezel to a desired position while giving the click feeling by the leaf spring, and setting the stopper to the engagement release prohibiting position to thereby prohibit to release the engagement between the recesses and projections of the bezel and the front end portion of the leaf spring when the position of the bezel finishes designating, the front end portion of the leaf spring can be maintained in a state of being engaged with the recesses and projections of the bezel and therefore, even when unprepared external force is exerted to the bezel, rotation of the bezel is always restrained by the front end portion of the leaf spring engaged with the recesses and projections of the bezel and therefore, there is not actually a concern of erroneously rotating the bezel. Therefore, when the bezel apparatus of the invention is integrated to, for example, a diver's watch, even when unprepared external force is exerted to the bezel positioned to a desired time position before diving, there is not actually a concern that the bezel is rotated in diving and a diving period of time is not known.

The 'recesses and projections' of the bezel to be engaged with the front end portion of the leaf spring may be a 'recess portion', that is, a recess or may be a 'projected portion', that is, a projection or may be provided with shape mixed with both of them.

According to the rotating type bezel apparatus of the invention, typically, when the stopper is disposed at the engagement release prohibiting position, the front end portion is supported from a back face to make the front end portion of the leaf spring stay in the recesses and projections of the bezel and when the stopper is disposed at the engagement release permitting position, the stopper is disposed at a location remote from the front end portion to permit to detach the front end portion from the recesses and projections of the bezel. In this case, the stopper may be formed simply reciprocably between the engagement release prohibiting position and the engagement release permitting position to thereby prohibit the stopper from being brought into contact with the back face of the front end portion of the leaf spring at the engagement release prohibiting position to elastically escape the front end portion of the leaf spring. However, when desired, at least either one of the stopper and the leaf spring may be provided with a more complicated shape or structure to support a portion of the leaf spring other than the back face when, for example, the stopper is disposed at the engagement release prohibiting position.

Further, not only in rotating the bezel but also in changing the position of the stopper, the click feeling may be given. In that case, finish of positioning of the stopper to the engagement release prohibiting position or the engagement release permitting position, or start of changing the position of the stopper from the above-described position, can be felt as an actual feeling and therefore not only there is less concern of setting or bringing the setting erroneously but also a mechanism of forming the click feeling is necessarily accompanied by provision of more less moving resistance at the two positions and therefore, there can be minimized also a concern of positional shifting of the stopper per se erroneously.

At any rate, when the click feeling is given in positioning the stopper or in changing the set position in the rotating type bezel apparatus of the invention, typically, there is provided a resistance providing means for providing a resistance to detachment of the stopper from at least either one position of the engagement release prohibiting position and the engagement release permitting position, or arrival thereof to the either one position.

Here, the resistance providing means may be a combination of a projected portion formed at the stopper and a recessed portion form at the case body portion at a position of engaging with the projected portion of the stopper when the stopper is disposed at at least either one position of the engagement release prohibiting position and the engagement release permitting position, further, when desired, the resistance providing means may use a combination of a recessed portion formed at the stopper and a projected portion arranged to the case body portion at a position of engaging with the recessed portion of the stopper and elastically deviated to a face of the recessed portion of the stopper having an opening when the stopper is disposed at at least either one position of the engagement release prohibiting position and the engagement release permitting position.

According to the rotating type bezel apparatus of the invention, when rotation of the bezel is permitted by the stopper, the bezel may be rotated only in one direction or may be rotated in two directions.

In the former case, typically, the recesses and projections of the bezel comprises a recess and the leaf spring and the bezel are constituted such that when the stopper is disposed at the engagement release permitting position and the front end portion of the leaf spring is engaged with inside of the recess of the bezel, a force exerted from the recess of the bezel to the front end portion of the leaf spring by rotating the bezel in the opposed direction, bends the leaf spring in a direction of pressing the front end portion to the recess of the bezel to thereby prohibit rotation of the bezel in the opposed direction. Further in details, typically, the front end portion of the leaf spring is provided with an inclined portion in which the more frontward in the direction of rotating the bezel, the more inclined in a direction of being fitted deeply in the recess, and when the bezel is going to be rotated in the opposed direction, a force in a direction of raising (direction of erecting) the leaf spring, is exerted from a wall portion of the recess of the bezel to a front end of the inclined portion of the front end portion of the leaf spring, the inclined portion of the front end portion of the leaf spring is pushed into the recess of the bezel to thereby prohibit rotation of the bezel in the opposed direction. However, when desired, there may be provided other one direction rotating mechanism for prohibiting rotation in the reverse direction. Further, the direction of permitting rotation may be a clockwise direction or a counterclockwise direction.

In the latter case, typically, the recesses and projections of the bezel comprise a recess and the leaf spring and the bezel are constituted such that when the stopper is disposed at the engagement release permitting position and the front end portion of the leaf spring is engaged with inside of the recess of the bezel, a force exerted from the recess of the bezel to the front end portion of the leaf spring by rotating the bezel in respective directions, bends the leaf spring in a direction of pushing out the front end portion from the recess of the bezel to thereby permit rotation of the bezel in the two directions. Further in details, typically, the front end portion of the leaf spring is provided with a first inclined portion inclined in a direction in which the more frontward in one rotating direction of two rotating directions of the bezel, the more deeply the front end portion of the leaf spring is fitted into the recess, and a second inclined portion extended to incline relative to the first inclined portion from a front end of the first inclined portion in a direction of being remote from the depth of the recess. The first and second inclined portions of the leaf spring as well as a wall portion of the recess of the bezel are respectively provided with shapes by which when the front end portion is engaged with the recess of the bezel and the stopper is disposed at the engagement release permitting position, in order to bend the leaf spring to draw the first or the second inclined portion of the leaf spring from the recess of the bezel in accordance with rotation of the bezel in the one or the opposed direction, corresponding inclined portions are guided by wall portions of the recess. However, other rotation permitting or rotation prohibiting mechanism may be provided to permit rotation of the bezel in the two directions while giving the click feeling.

The rotating type bezel apparatus of the invention is typically used by being integrated to a portable timepiece such as a watch. However, when desired, the rotating type bezel apparatus may be integrated to other apparatus.

BRIEF DESCRIPTION OF THE DRAWINGS

FIG. 3A is a sectional explanatory view and FIG. 3B is a perspective explanatory view of a state of removing the bezel;

FIG. 5A is a sectional explanatory view similar to FIG. 3A and FIG. 5B is a perspective explanatory view of a state of removing the bezel similar to FIG. 3B;

FIG. 7A is a sectional explanatory view of a rotating permitting state similar to FIG. 3A of an example of a rotating type bezel apparatus in which a bezel can be rotated only in one direction and a main body of a click spring is folded to bend at a front end portion thereof, and FIG. 7B is a perspective explanatory view of a rotation permitting state similar to FIG. 3B of an example of a rotating type bezel apparatus in which a bezel can be rotated only in one direction and a main body of a click spring is bent to warp totally; FIG. 8A is a sectional explanatory view of a case in which the rotating type bezel apparatus of FIG. 7A is brought into a rotation prohibiting state similar to FIG. 5A and FIG. 8B is a perspective explanatory view of a case in which the rotating type bezel apparatus of FIG. 7B is brought into a rotation prohibiting state similar to FIG. 5B.

DETAILED DESCRIPTION OF THE PREFERRED EMBODIMENTS

Figure 1:
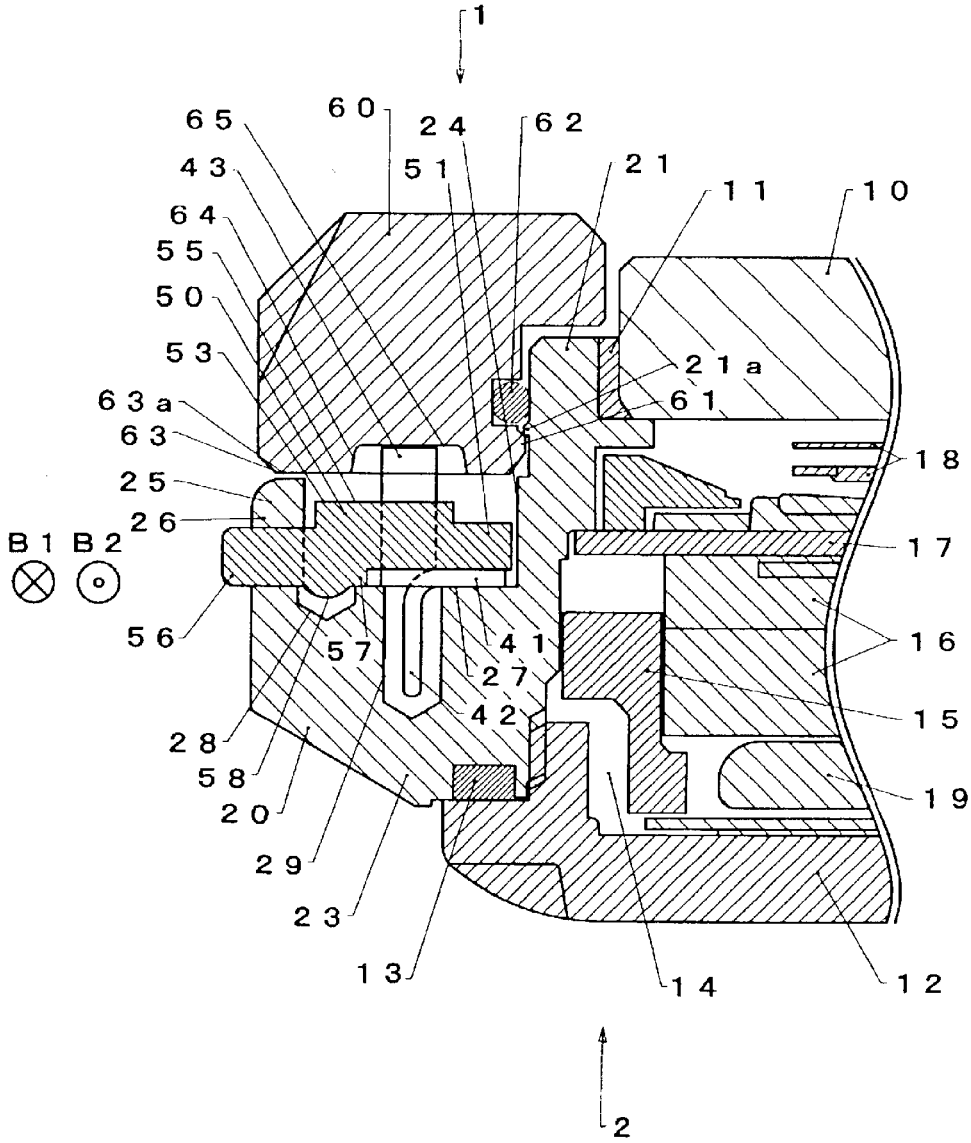
FIG. 1 is a sectional explanatory view of the portable timepiece having a rotating type bezel apparatus of a preferable embodiment according to the invention and is a sectional explanatory view taken substantially along a line I—I of FIG. 2.
Figure 2:
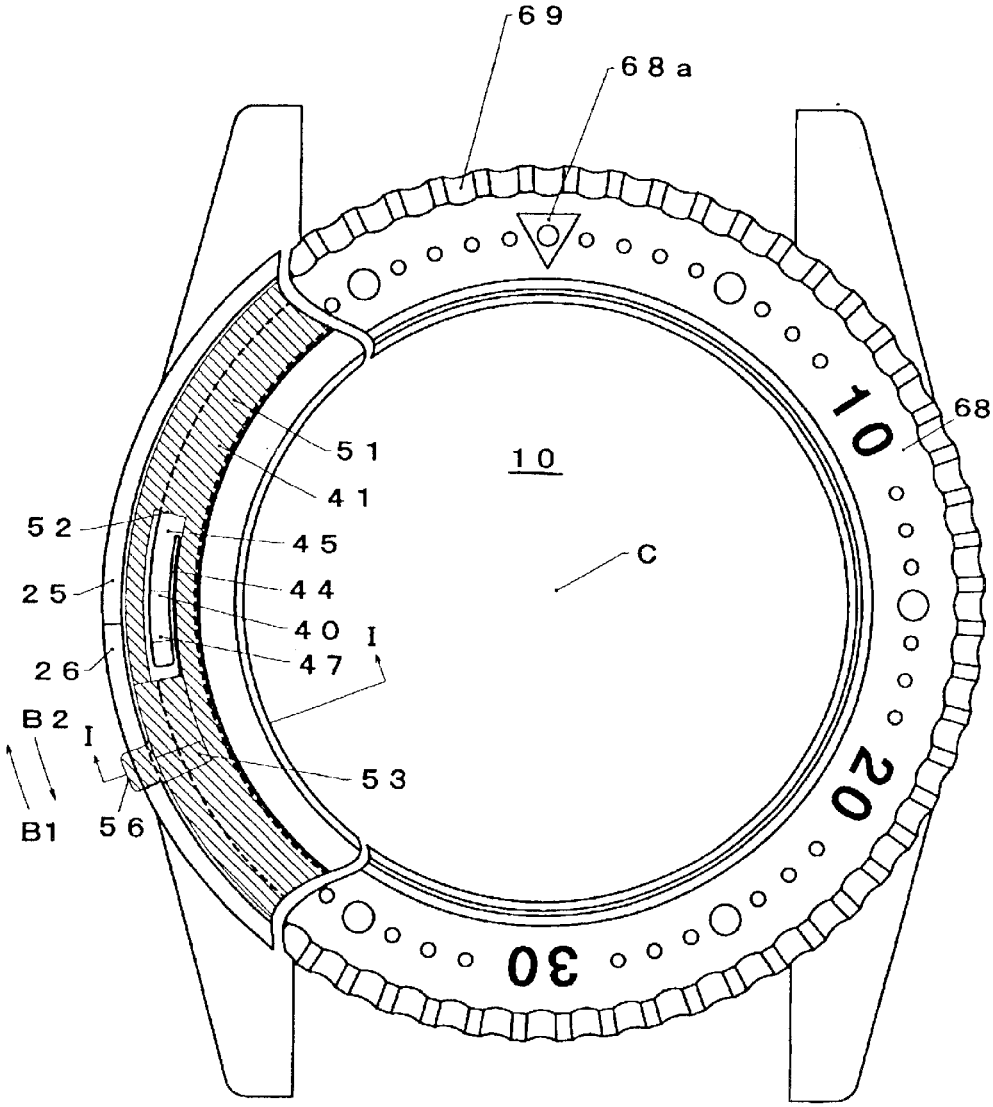
FIG. 2 is a plane explanatory view of a state of permitting rotation of a bezel in the portable timepiece of FIG. 1.

Next, an explanation will be given of several modes for carrying out the invention based on preferable embodiments shown in the attached drawings.

FIG. 1 through FIGS. 5A–5B show a portable timepiece 2 of a preferable embodiment according to the invention having a rotating type bezel apparatus 1 according to a preferable first embodiment of the invention.

The portable timepiece 2 is provided with a case body 20 in a ring-like shape. The case body 20 includes a case main body portion 21 substantially in a cylindrical shape and a thick-walled flange-like portion 23 projected from a lower end portion, that is, from a back side end portion 22 outwardly in a radius direction thereof. A front face side of the case body 20 is attachedly fitted with a glass plate 10 via a packing 11 for sealing and a back face side thereof is attachedly screwed with a case back 12. Numeral 13 also designates a packing for sealing. At a watertight chamber 14 formed by the case body 20, the glass plate 10 and the case back 12, there are arranged and contained a movement 16 supported by a middle frame 15 at a central portion thereof, a dial 17 and hands 18 on a front face side thereof and a battery 19 or the like on a back face side thereof.

Figure 3A:
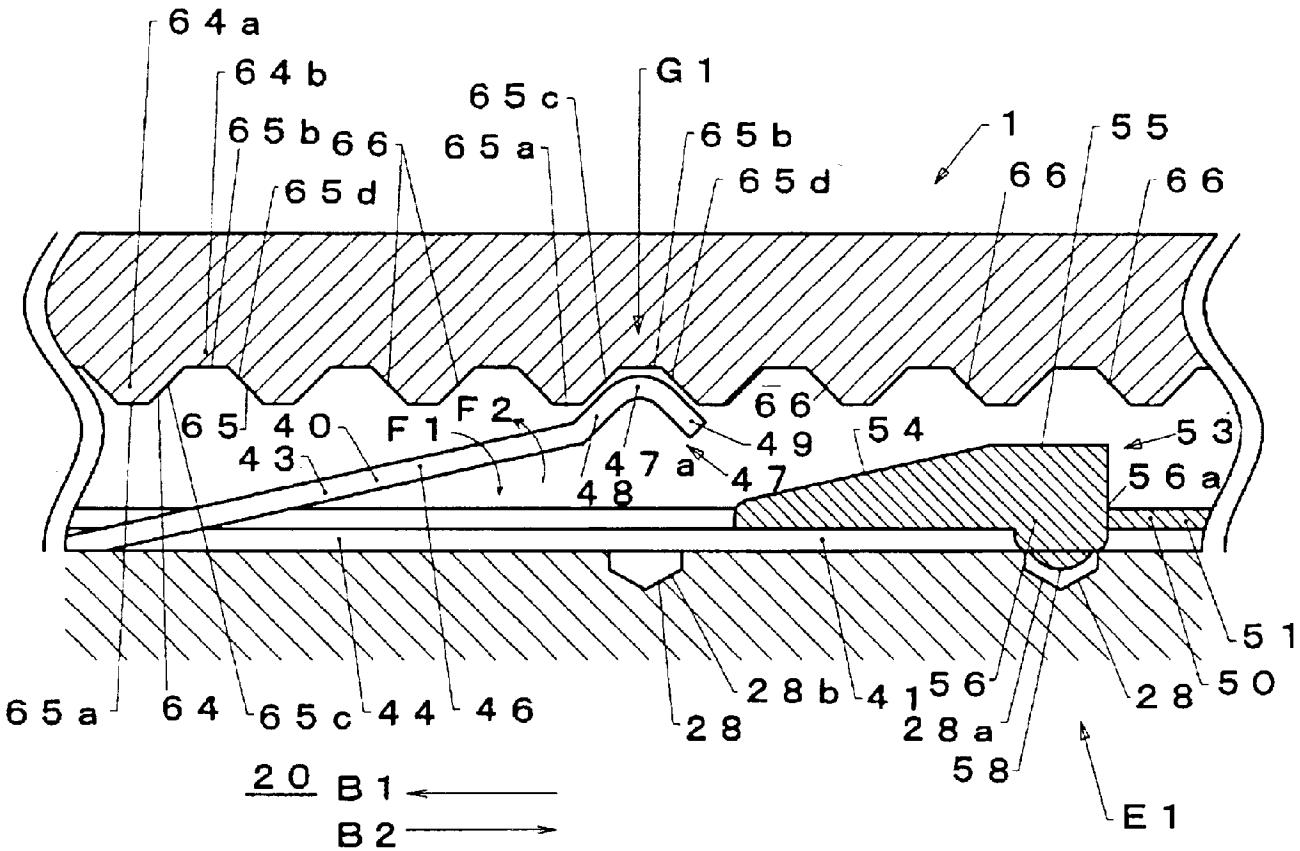
FIGS. 3A–3B show a positional relationship among a bezel, a click spring and a stopper in the rotating type bezel apparatus of the portable timepiece in the rotating permitting state, where
Figure 5A:
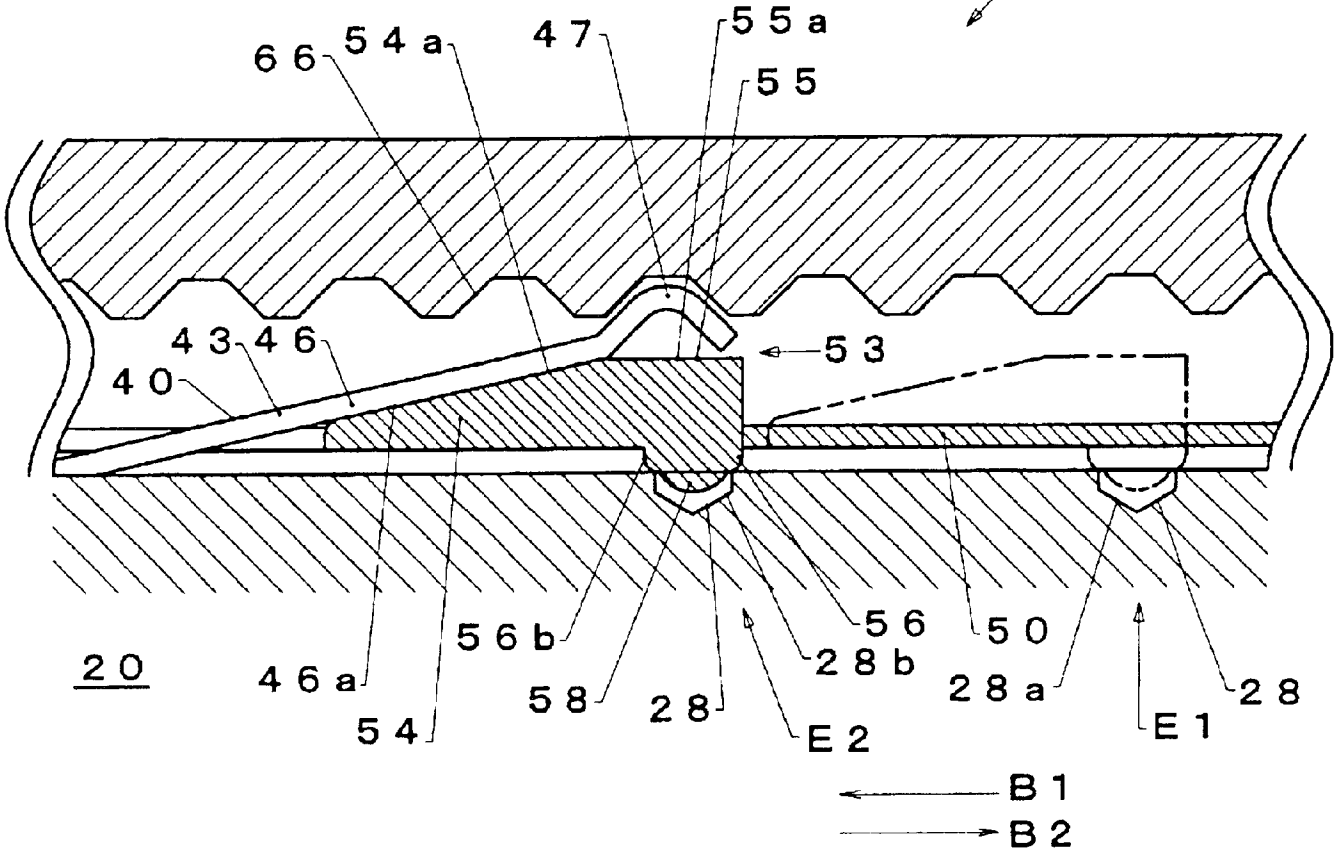
FIGS. 5A–5B show a positional relationship among the bezel, the click spring and the stopper in the rotating type bezel apparatus of the portable timepiece in the rotating prohibiting state, where
Figure 5B:
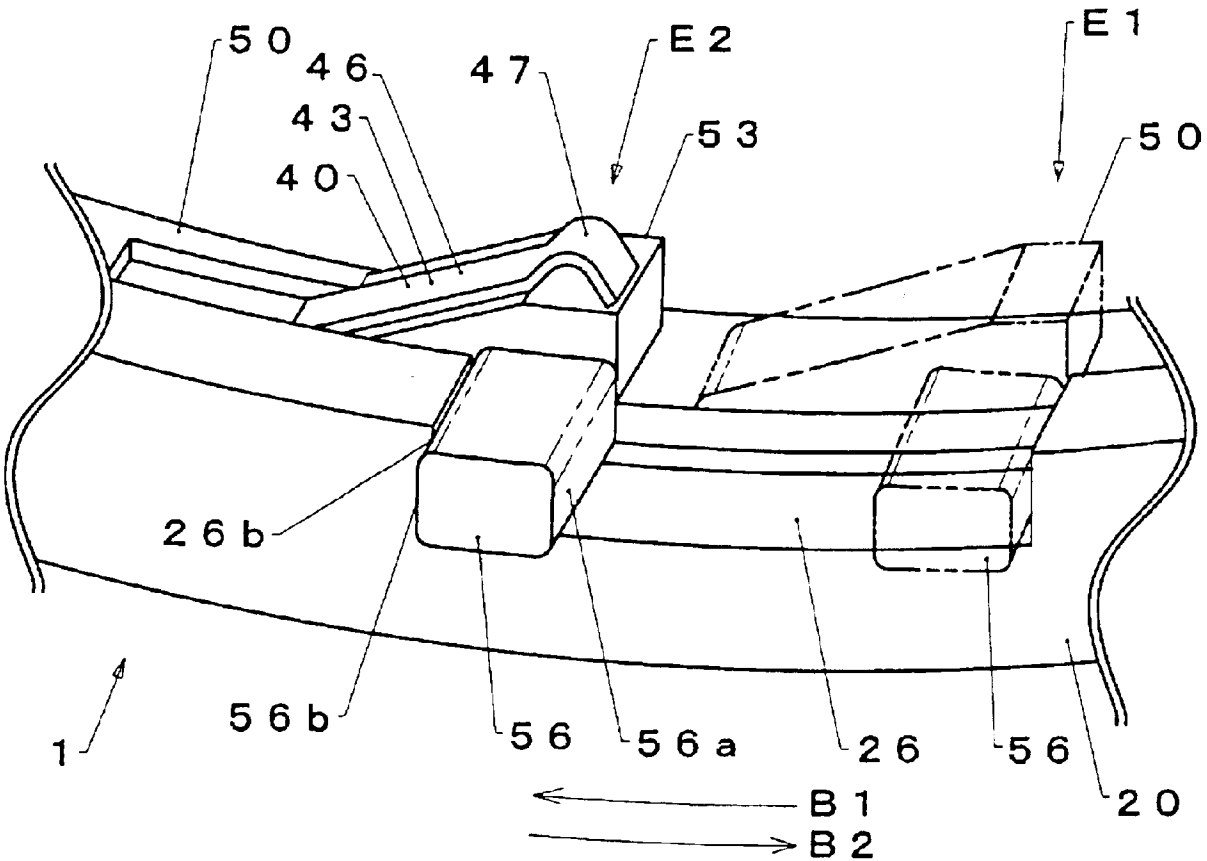

The flange-like portion 23 of the case body 20 includes a ring-like recessed portion 24 at a front face thereof and an outer side wall 25 of the ring-like recessed portion 24 is formed with a notch 26 having a predetermined length in the peripheral direction, that is, in B1 and B2 directions. As shown by FIG. 3A and FIG. 5A, a bottom wall 27 of the ring-like recessed portion 24 is further formed with shallow circular recessed portions 28, 28, that is, 28*a*, 28*b* at vicinities of both end portions of the notch 26. The bottom wall 27 of the ring-like recessed portion 24 is further formed with a spring attaching recessed portion 29 (FIG. 1). Further, although as if the spring attaching recessed portion 29 were present only at one location in the peripheral direction, preferably, the attaching recessed portions 29 are formed at a plurality of locations, for example, at two locations at an interval of 180 degrees in the peripheral direction or at three locations at an interval of 120 degrees in the peripheral direction.

The ring-like recessed portion 24 of the case body 20 is arranged with a first member in the form of a click spring 40 having a ring-like shape. The click spring 40 includes a base portion 41 in a shape of a plate having a wide width and in a ring-like shape or an annular shape, a spring attaching portion 42 folded to bend from the base portion 41 and extended to the back face side, and a spring main body portion 43 raised skewedly from the base portion 41. The spring main body portion 43 is formed by notching a portion of the base portion 41 on an outer side thereof in the width direction along a notch line 44 (FIG. 2) over a predetermined length in the peripheral direction, continuously connected to the base portion 41 at a base end 45 thereof and supported by the base portion 41. The spring main body portion 43 includes an inclined spring portion 46, and a front end engaging portion or a claw portion 47 formed on a front end side of the inclined spring portion 46. The front end engaging portion 47 includes a first projection forming inclined portion 48 raised skewedly further from a front end of the inclined spring portion 46, and a second projection forming inclined portion 49 skewedly lowered relative to the first projection forming inclined portion 48 and a connecting portion 47*a* connecting the first and second projection forming inclined portions 48 and 49, is bent smoothly in a projected shape.

Although the spring main body portion 43 may be formed at one location of the click spring 40 in the ring-like shape in the peripheral direction, preferably, for example, the spring main body portions 43 are formed at a plurality of locations, for example, at two locations at an interval of 180 degrees in the peripheral direction or three locations at an interval of 120 degrees in the peripheral direction. The spring attaching portion 42 is precisely fitted to the spring attaching recessed portion 29 to thereby specify a position thereof in the peripheral direction. Although in FIG. 1, a width of the spring attaching recessed portion 29 is far larger than a thickness of the spring attaching portion 42 of the click spring 40, positions and lengths of the two members 29 and 42 in the peripheral direction are substantially to the same degrees.

The ring-like recessed portion 24 of the case body 20 is arranged with a second member in the form of a stopper 50 along the peripheral direction movably in B1 and B2 directions. The stopper 50 has a ring-like shape and includes a base portion 51 in a shape of a ring-like plate arranged above the ring-like base portion 41 of the click spring 40, that is, on a front face side thereof at inside of the ring-like recessed portion 24, an opening portion 52 extended in the peripheral direction by a predetermined length to permit projection of the spring main body portion 43 of the click spring 40, and stopper main body portion 53 formed at one end side of the opening portion 52 in the peripheral direction. The stopper main body portion 53 includes an inclined face portion 54 substantially in parallel with the inclined spring portion 46 of the spring main body portion 43 of the click spring 40 and having a length to a degree substantially the same as the inclined spring portion 46, and a top horizontal face portion 55 having a length in the peripheral direction to a degree substantially the same as the inclined spring portion front end engaging portion 47 of the spring main body portion 43.

The opening portions 52 and the stopper main body portions 53 are formed at positions and by a number in correspondence with positions and a number of the spring main body portion 43 of the click spring 40. The stopper 50 is provided with an operating projected portion 56 projected outwardly in the radius direction from an outer peripheral wall of the stopper main body portion (when a plurality of pieces of the stopper main body portions 53 are provided, one of them) 53, and the operating projected portion 56 is projected outwardly in the radius direction precisely at the notch portion 26 of the outer side wall portion 25 of the ring-like recessed portion 24. As is known from FIG. 1, the stopper main body portion 53 is projected in a width direction (radius direction) up to an outer side of the ring-like base portion 41 of the click spring 40 in the radius direction and at an outer side portion 57 thereof in the radius direction, the stopper main body portion 53 is brought into direct contact with the bottom wall 27 of the ring-like recessed portion 24 of the case body 20 and is supported by the bottom wall 27. A bottom face of an outer end of the stopper main body portion 53 in the radius direction, is formed with a projection 58 projected in a lower direction (back direction) in a partially spherical shape or a dome-like shape.

Figure 3B:
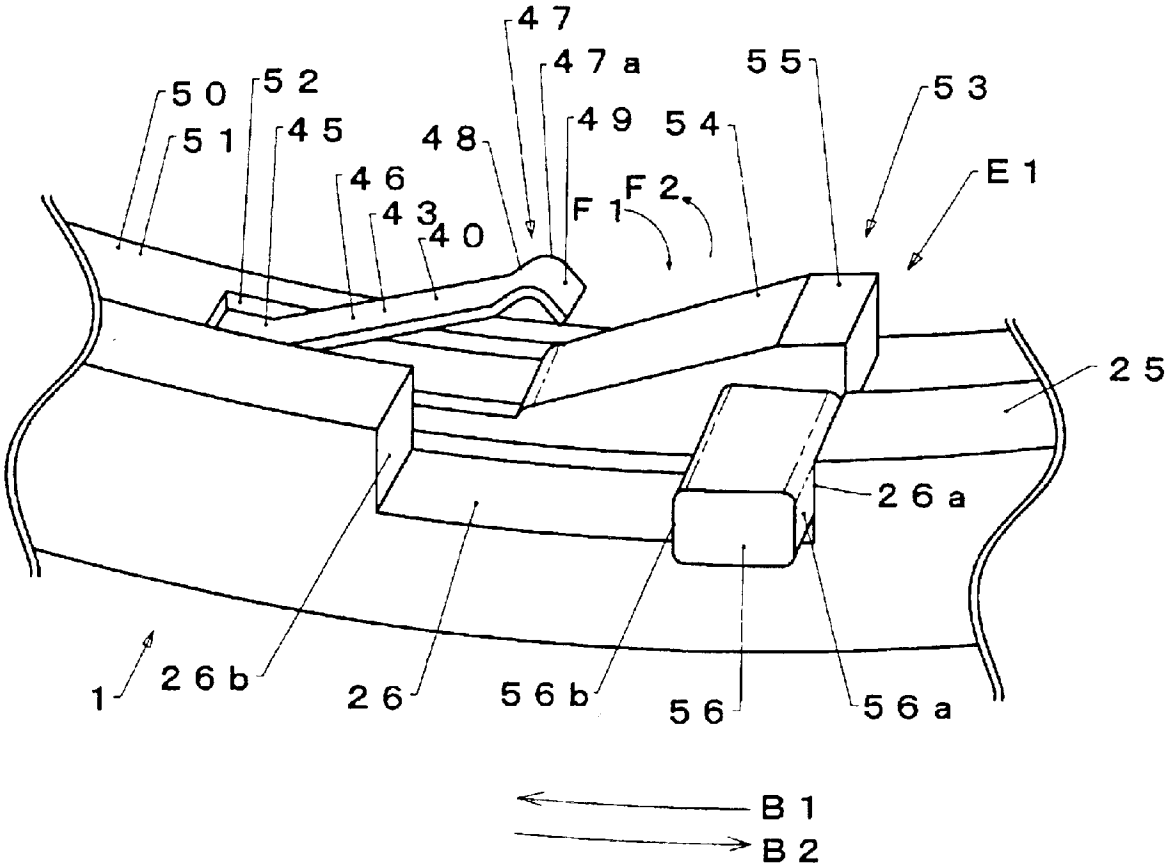
Figure 4:
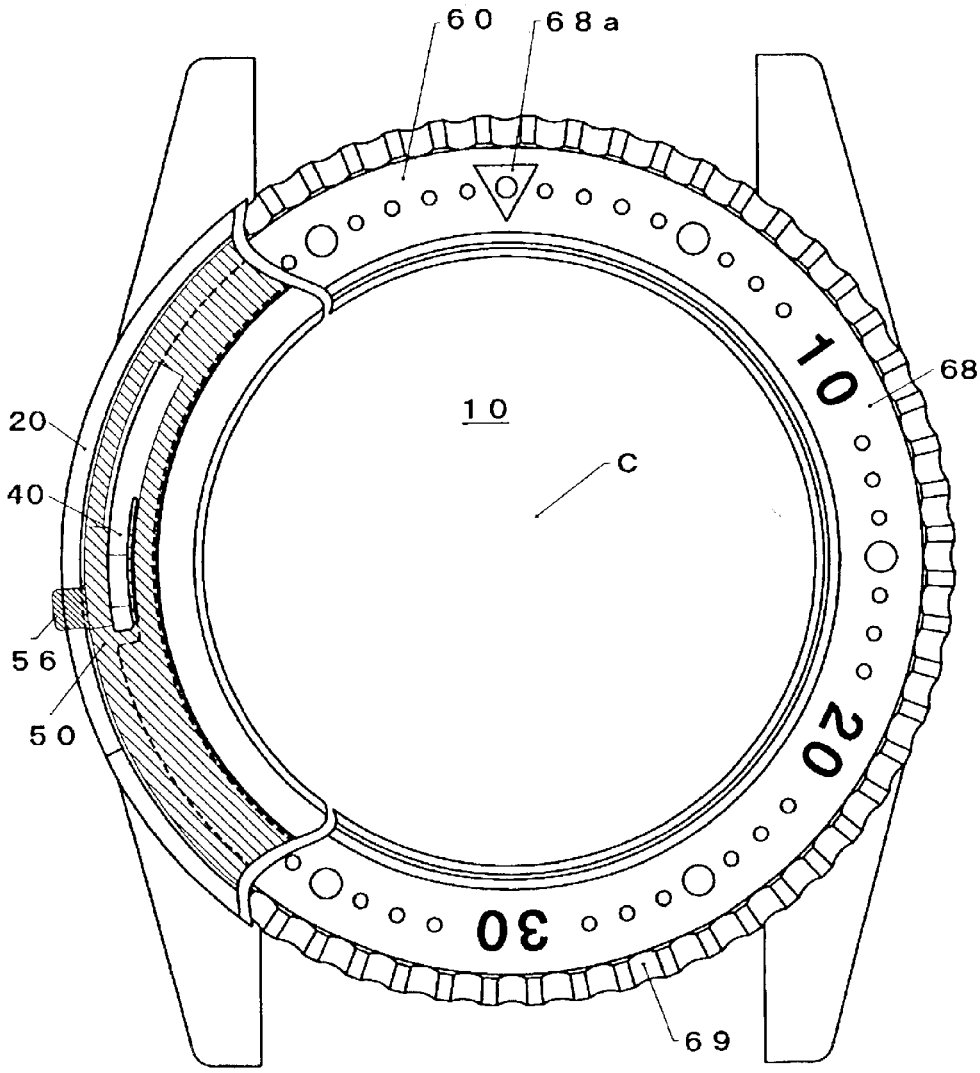
FIG. 4 is a plane explanatory view similar to FIG. 2 in a state of prohibiting rotation of the bezel in the portable timepiece of FIG. 1.

Therefore, the stopper 50 is movable in B1 and B2 directions between an engagement release permitting position or an unlock position E1 (FIG. 2 and FIG. 3) at which a side face 56*a* of the operating projected portion 56 is brought into contact with an end wall 26*a* on one side of the notch portion 26 of the outer side wall portion 25 of the ring-like recessed portion 24, and an engagement release prohibiting position or a lock position E2 (FIG. 4 and FIG.

5) at which the side face 56*b* of the operating projected portion 56 is brought into contact with an end wall 26*b* on other side of the notch portion 26.

When the stopper 50 is disposed at position E1, the dome-like projection 58 at the bottom face of the stopper 50 is precisely engaged with one hole 28*a* in the shallow holes (the shallow circular recessed portions) 28, 28 (that is, 28*a*, 28*b*) of the ring-like recessed portion 24 of the case body 20. When the stopper 50 is disposed at position E1, the inclined face portion 54 and the horizontal face portion 55 of the stopper main body portion 53 are positioned remotely from the spring main body portion 43 in the peripheral direction B2 and the spring main body portion 43 is deformable in F1 direction owing to the bending elasticity (further, when there is an allowance (space) in deformation, naturally, deformable also in an opposed direction F2).

Meanwhile, when the stopper 50 is disposed at position E2, the dome-like projection 58 at the bottom face of the stopper 50 is precisely engaged with one hole 28*b* in the shallow holes (the shallow circular recessed portions) 28, 28 (that is, 28*a*, 28*b*) of the ring-like recessed portion 24 of the case body 20 (FIG. 5A). When the stopper 50 is disposed at position E2, the inclined face portion 54 and horizontal face portion 55 of the stopper main body portion 53 are brought into contact with the spring main body portion 43 from a back face (rear face) side or a position proximate to the back face of the spring main body portion 43 to thereby restrict or substantially prohibit deformation or displacement of the spring main body portion 43 in F1 direction.

The cylindrical portion (case main body portion) 21 of the case body 20 is fitted with a bezel 60 rotatably in B1 and B2 directions relative to the case body 20. The bezel 60 is prevented from being drawn by engaging with a projection 21*a* of the cylindrical portion 21 of the case body 20 at a projection 61 of an inner peripheral edge thereof. Numeral 62 designates a ring for preventing play of the bezel 60. The bezel 60 is provided with a ring-like recessed portion 64 constituting recesses and projections at a bottom wall 63 thereof and a bottom face 65 of the recessed portion 64 includes horizontal faces 65*a* and 65*b* at a ridge portion 64*a* and a valley portion 64*b* and includes inclined faces 65*c* and 65*d* for connecting the ridge portion horizontal faces 65*a* and the valley portion horizontal faces 65*b*. Further, in the illustrated example, the top portion horizontal face 65*a* is actually flush with a horizontal face 63*a* of the bottom wall 63 and in this case, a number of recesses 66 are aligned in a circular shape at equal intervals to form the ring-like recessed portion 64 as a whole. However, the ridge portion horizontal face 65*a* may not be flush with the horizontal face 63*a* of the bottom wall 63 and in that case, preferably, the top portion horizontal face 65*a* is disposed on the depth side of the horizontal face 63*a*.

The recess 66 specified by the inclined faces 65*c* and 65*d* and the valley portion 64*b* therebetween is provided with a substantially complementary shape by which the front end engaging portion 47 of the click spring 40 is substantially fitted thereto as shown by, for example, FIG. 3A. The recess 66 of the bezel 60 is provided with the inclined faces 65*c* and 65*d* which are expanded to the opening side and the front end engaging portion 47 of the click spring 40 is provided with the inclined faces 48 (the first projection forming inclined portion 48) and 49 (the second projection forming inclined portion 49) expanded in B1 and B2 directions by being remote from the projected connecting portion 47*a* and therefore, as shown by FIGS. 3A and 3B, in the case in which the stopper main body portion 53 is disposed at the engagement release permitting position, that is, the unlock position E1 remote from the click spring main body position 43, when the bezel 60 is rotated in B1 direction, the inclined face 65*d* of the recess 66 pushes the inclined portion (the second projection forming inclined portion) 49 of the front end engaging portion 47 of the click spring 40 substantially in G1 direction and when the bezel 60 is rotated in B2 direction, the inclined face 65*c* of the recess 66 pushes the inclined portion (the first projection forming inclined projection) 48 of the front end engaging portion 47 of the click spring 40 substantially in G1 direction and in either of the cases, the click spring main body portion 43 is pivoted to bend in F1 direction to push out the front end engaging portion 47 to outside of the recess 66. Meanwhile, when the ridge connecting portion 47*a* of the front end engaging portion 47 of the click spring 40 elastically deviated in F2 direction, rides over the ridge portion (the ridge portion horizontal face) 65*a* in a sawtooth-like shape of the bezel 60, by elasticity of the spring 40, the front end engaging portion 47 is fitted to a successive one of the recess 66 of the bezel 60.

Further, a surface 67 of the bezel 60 is attached with a graduation 68 and by rotating an original point position 68*a* to set to time of, for example, a diving start time point (position of minute hand in the illustrated example), a time period after start diving is known. Further, instead of a diving continuation time period, a remaining allowable diving time period may be made optically recognizable directly from the position of the hand of the timepiece. Numeral 69 designates a decorative bezel comprising recesses and projections serving also as an anti-slip portion touched with the finger tip when the bezel 60 is rotated and the decorative bezel is formed by knurling or knurling cutting.

When the portable timepiece 2 having the rotating type bezel apparatus 1 according to the preferable first embodiment of the invention constituted as described above, is constituted by a diver's watch, before starting to dive, the bezel 60 of the rotating type bezel apparatus 1 is set to current time or time scheduled to start diving.

For that purpose, first, the operating knob portion (the operating projected portion) 56 is rotated by the finger tip in B2 direction until the end face 56*a* of the operating projected portion56 constituting the operating knob portion is brought into contact with the end face 26*a* of the notch 26 of the case body 20 to thereby set the stopper 50 to the engagement release permitting position or the unlock position E1. At this occasion, the projection 58 of the bottom portion of the stopper 50 is fitted to the recess (the shallow circular recessed portion) 28*a* of the bottom wall 27 of the ring-like recessed portion 24 of the case body 20.

Next, by pinching the decorative bezel (knurled portion) 69 having the anti-slip portion of the bezel 60 by the finger tips, the bezel 60 is rotated in B1 direction or B2 direction until the start point 68*a* of the graduation 68 of the bezel 60 coincides with the position of the minute hand at current time or time scheduled to start diving. As a rotating direction thereof, for example, there may be selected a direction easy to rotate or a direction having a smaller angle from the position of the start point 68*a* to a position to be designated at that occasion. When the bezel is accidentally rotated excessively to exceed the predetermined position, the bezel may be set to the predetermined position by slightly rotating the bezel in the reverse direction. When the stopper 50 is disposed at position E1, there is a gap between the spring main body portion 43 of the click spring 40 and the stopper main body portion 53 of the stopper 50 and therefore, the spring main body portion 43 of the click spring 40 can be bent in F1 direction and therefore, the bezel 60 can be rotated in B1 or B2 direction while bending the spring main body portion 43 in F1 direction by pushing a corresponding one of the inclined portion (the second projection forming inclined portion 49) 49 or 48 (the first projection forming inclined portion 48) of the front end engaging portion 47 of the click spring 40 substantially in G1 direction by the inclined face 65*d* or 65*c* of the recess 66. In rotating the bezel, at each rotation of the bezel 60 at a predetermined pitch (angle), the front end engaging portion 47 of the click spring 40 is brought to and from the recess 66 of the bottom face (bottom wall) 63 of the bezel 60 and therefore, in rotating the bezel 60 in B1 or B2 direction, a desired click feeling is given. In this way, rotation or positioning of the bezel 60 to a desired, position is finished at a position at which the front end engaging portion 47 of the click spring 40 is precisely fitted to the recess 66 of the bezel 60.

Next, by pinching the front end of the operating projected portion 56 by the fingers and moving the operating projected portion 56 in B2 direction relative to the case body 20 until the side face 56*b* of the operating projected portion 56 of the stopper 50 is brought into contact with the end face 26*b* of the notch 26 of the face body 10, the stopper 50 is moved from the engagement release permitting position (unlock position) E1 to the engagement release prohibiting position (lock position) E2. Thereby, the stopper 50 is positioned by precisely fitting the dome-like projection 58 of the bottom portion to the recess 28*b* to the bottom wall 27 of the ring-like recessed portion 24 of the case body 20.

When the stopper 50 reaches position E2, as is known from FIG. 4 and FIG. 5, a surface (inclined face) 54*a* of the inclined face portion 54 of the stopper main body portion 53 of the stopper 50 is substantially brought into contact with a back face 46*a* of the inclined spring portion 46 of the spring main body portion 43 of the click spring 40 and further, a surface (horizontal face) 55*a* of the horizontal face portion 55 is disposed at a vicinity of the front end engaging portion 47 of the click spring 40. As a result, bending deformation or pivoting movement of the stopper main body portion 53 of the click spring 40 in F1 direction is prohibited by the stopper 50. Therefore, in a state of setting the stopper 50 to position E2, even when the bezel 60 is intended to rotate in B1 direction, or intended to rotate in B2 direction, there is not an allowance of escaping the click spring 40 supported by the back face 46*a* by the stopper 50 and therefore, the click spring 40 fitted to the recess 66 of the bezel 60 at the front end engaging portion 47, restricts or prohibits rotation of the bezel 60. That is, there is not actually a concern of rotating the bezel 60 unpreparedly.

Figure 6:
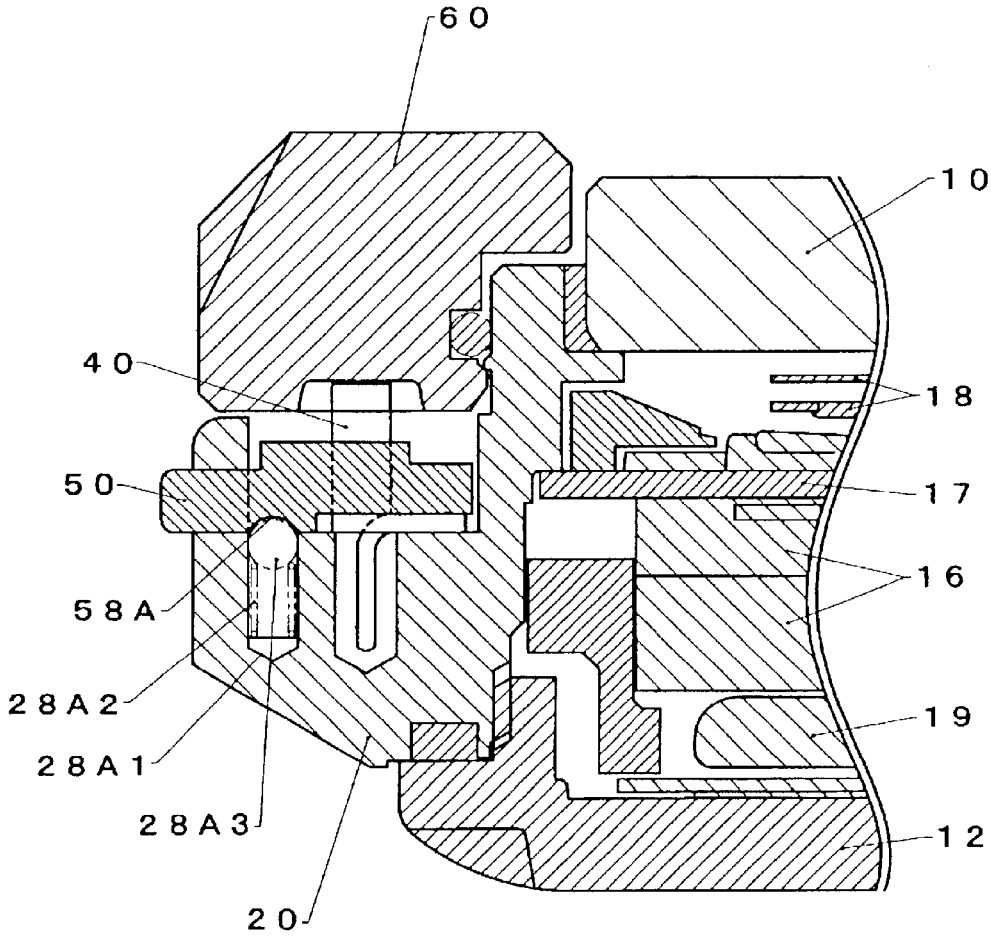
FIG. 6 is a sectional explanatory view similar to FIG. 1 of a portable timepiece having a rotating type bezel apparatus according to a modified example.

Further, in order to position the stopper 50, instead of forming the dome-like projected portion 58 as the bottom portion of the stopper 50 and providing the recesses (the shallow circular recessed portions) 28, 28, that is, 28*a*, 28*b* at the bottom portion (bottom wall) 27 of the ring-like recessed portion 24 of the case body 20, as shown by FIG. 6, there may be constructed a constitution in which a recess or a recessed portion 58A in a partially spherical shape or a dome-like shape, is formed at, for example, a position of the bottom portion of the stopper 50 at which the projection 58 has been present, a hole 28A1 is formed at the bottom portion 27 of the ring-like recessed portion 24 of the case body 20 at, for example, a position at which each of the recesses 28*a* and 28*b* has been present, a compression spring 28A2 is fitted into the hole 28A1 and a small ball 28A3 is pushed up in G2 direction by other end of the compression spring 28A2 one end of which is supported by a bottom wall of the hole 28A1.

In this case, at each time that the stopper 50 reaches the engagement release permitting position E1 or the engagement release prohibiting position E2, the small ball 28A3 deviated in G2 direction by the compression spring 28A2 is fitted to the recessed portion 58A of the bottom portion of the stopper 50 and therefore, when the stopper 50 is moved in B1 or B2 direction between positions E1 and E2, at each time of reaching positions E1 and E2, the click feeling is given and the stopper 50 can further stably be held at positions E1, E2.

Further, in the rotating bezel apparatus 1, instead of being capable of rotating the bezel 60 in two directions B1 and B2, the rotating bezel apparatus 1 may be constituted to be rotatable only in, for example, the B2 direction.

Figure 7A:
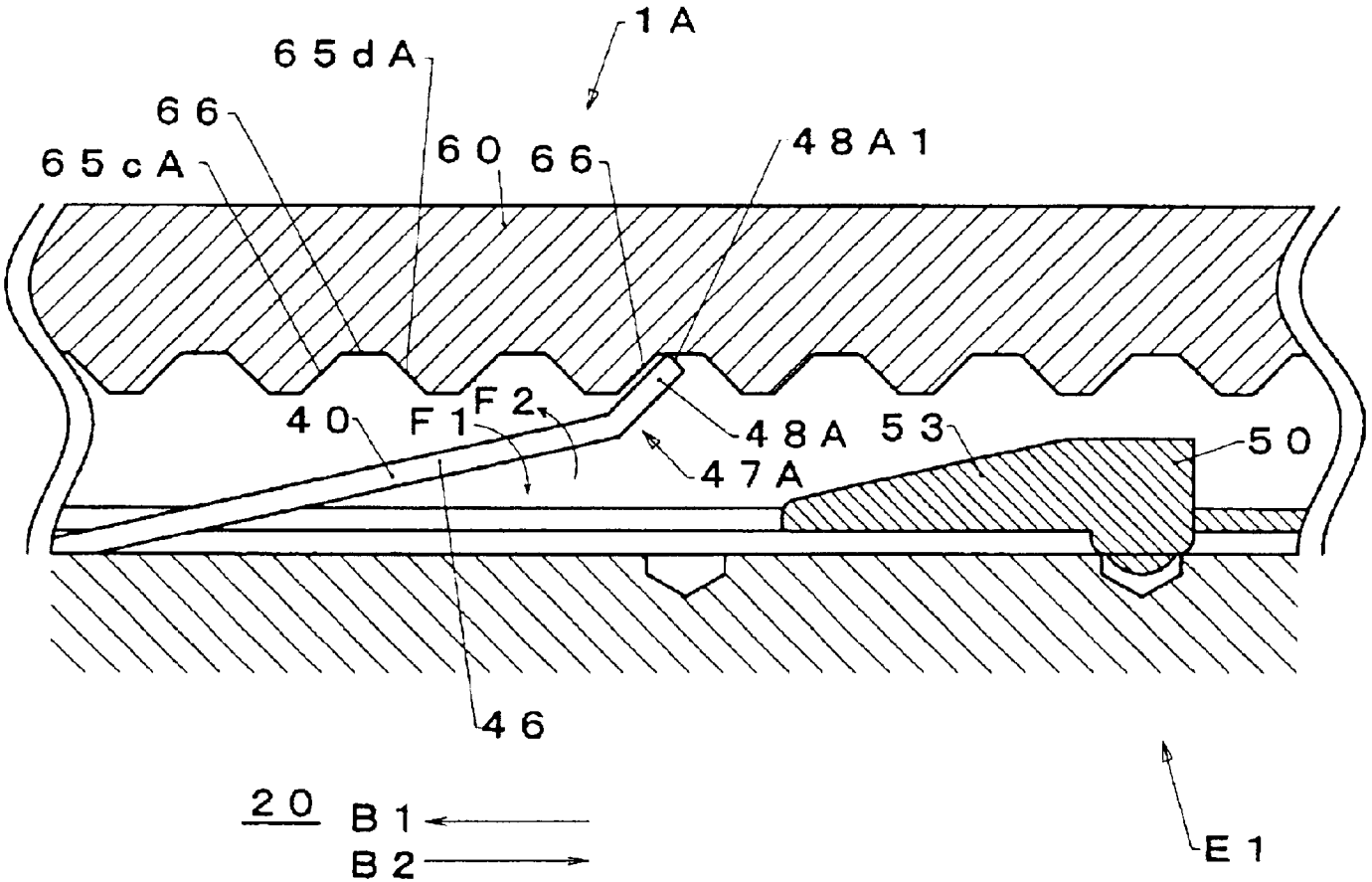
FIGS. 7A–7B show a rotating permitting state of a modified example of the invention, where
Figure 8A:
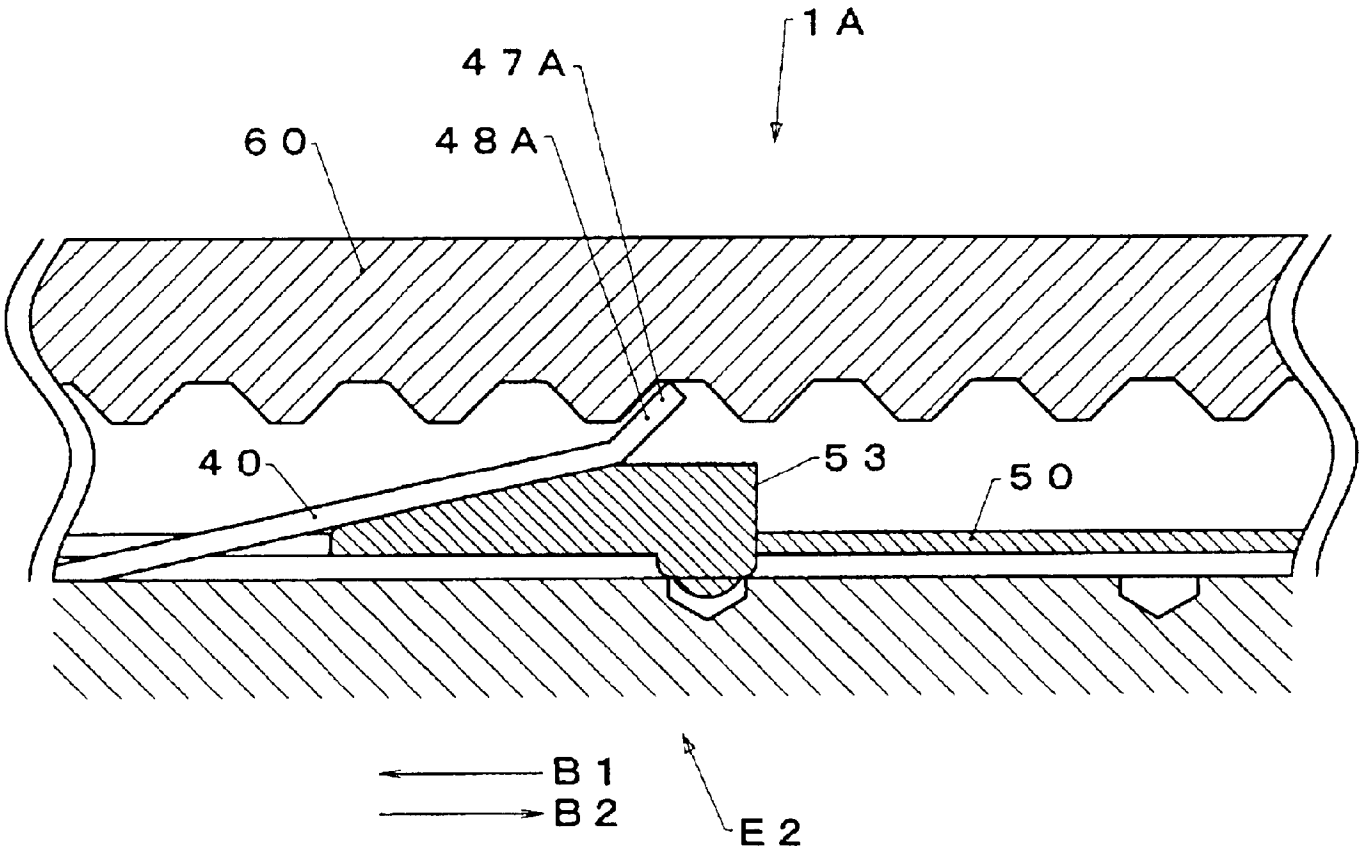
FIGS. 8A–8B show a rotation prohibiting state of a modified example shown in FIGS. 7A–7B, where

Instead of providing the front end engaging portion or the claw portion 47 having the inclined portion 48 and the incline portion 49 connected by being folded to bend at the connecting portion 47*a* by the click spring 40, for example, as shown by FIG. 7A and FIG. 8A, there may be constructed a constitution in which there is provided a front end engaging portion or claw portion 47A having only an inclined portion 48A longer measurements than the inclined portion 48, the inclined portion 48A is brought into contact with the recess 66 of the bezel 60 at a front end 48A1 thereof and an angle of inclination of an inclined face 65*d*A directed frontward in B1 direction is made larger than that of an inclined face 65*c*A directed frontward in B2 direction in the two inclined faces forming the recess According to a rotating bezel apparatus 1A of a modified example shown in FIG. 7A and FIG. 8A, in the case in which the stopper 50 is disposed at the engagement release permitting position E1 (FIG. 7A), when the bezel 60 is exerted with rotational force in B2 direction, the inclined face 65*c*A of the recess 66 of the bezel 60 pushes the inclined portion 48A of the front end engaging portion or claw portion 47A of the click spring 40 in B2 direction to thereby bend the inclined spring portion 46 to pivot in F1 direction and therefore, the bezel 60 can be rotated in B2 direction. Meanwhile, when the bezel 60 is exerted with rotational force in B1 direction, the inclined face 65*d*A of the recess 66 of the bezel 60 is butted to the front end 48A1 of the inclined portion 48A of the front end engaging portion or claw portion 47A of the click spring 40 in B1 direction, however, the force exerted to the click spring 40, exerts a torque of bending the inclined spring portion 46 to pivot in F2 direction and therefore, rotation of the bezel 60 is hampered by the front end engaging portion or claw portion 47A of the click spring 40 and therefore, the bezel 60 cannot be rotated in B1 direction. That is, the bezel 60 can be rotated only in B2 direction. The other point is operated similarly to the rotating type bezel apparatus 1 and the portable timepiece 2 having the same shown in FIG. 1 through FIG. 5.

Further, even in the case of the click spring 40 having the engaging portion 47 provided with the inclined portion 49 in addition to the inclined portion 48 as shown by FIG. 3 or the like, when the inclined face 65*d* or the inclined portion 49 is provided with a position or a shape by which a force exerted from the inclined face 65*d* of the recess 66 of the bezel 60 to the inclined portion 49 of the front end engaging portion 47 of the click spring 40, exerts a torque in F2 direction to the inclined spring portion 46 of the spring 40, the bezel is operated similar to the modified example.

Figure 7B:
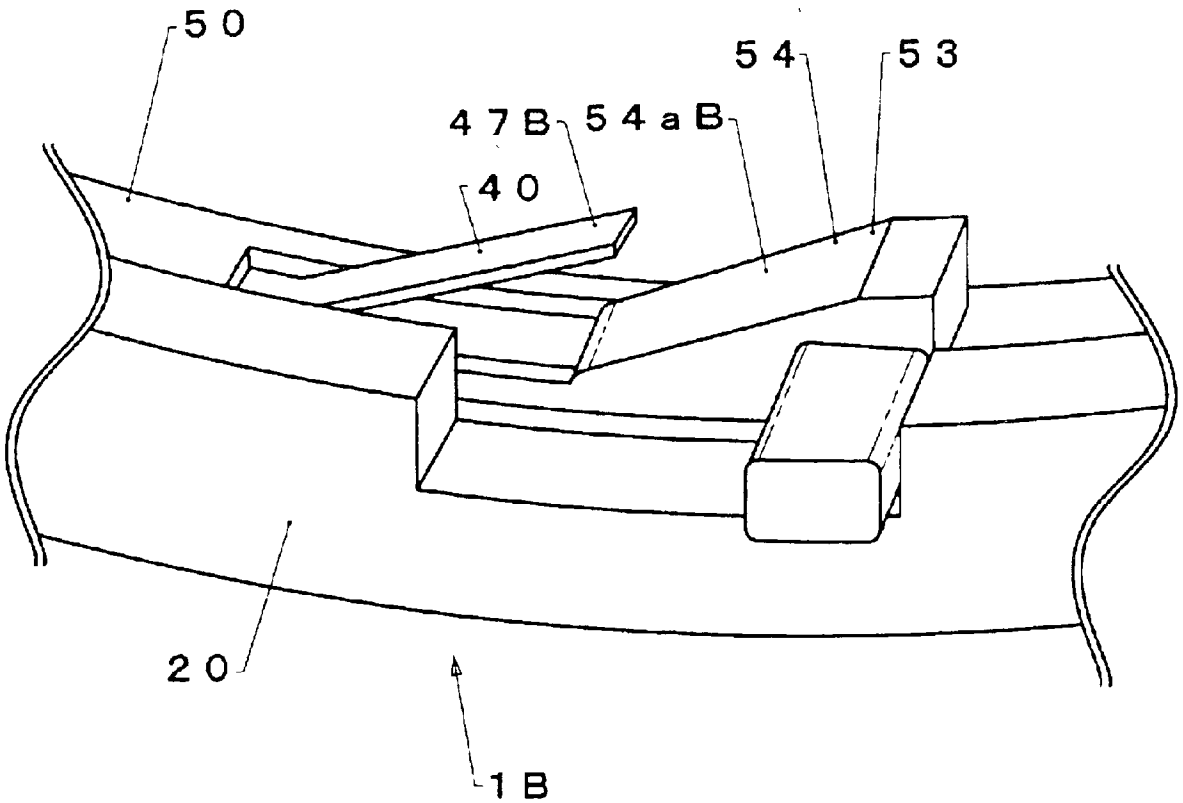
Figure 8B:
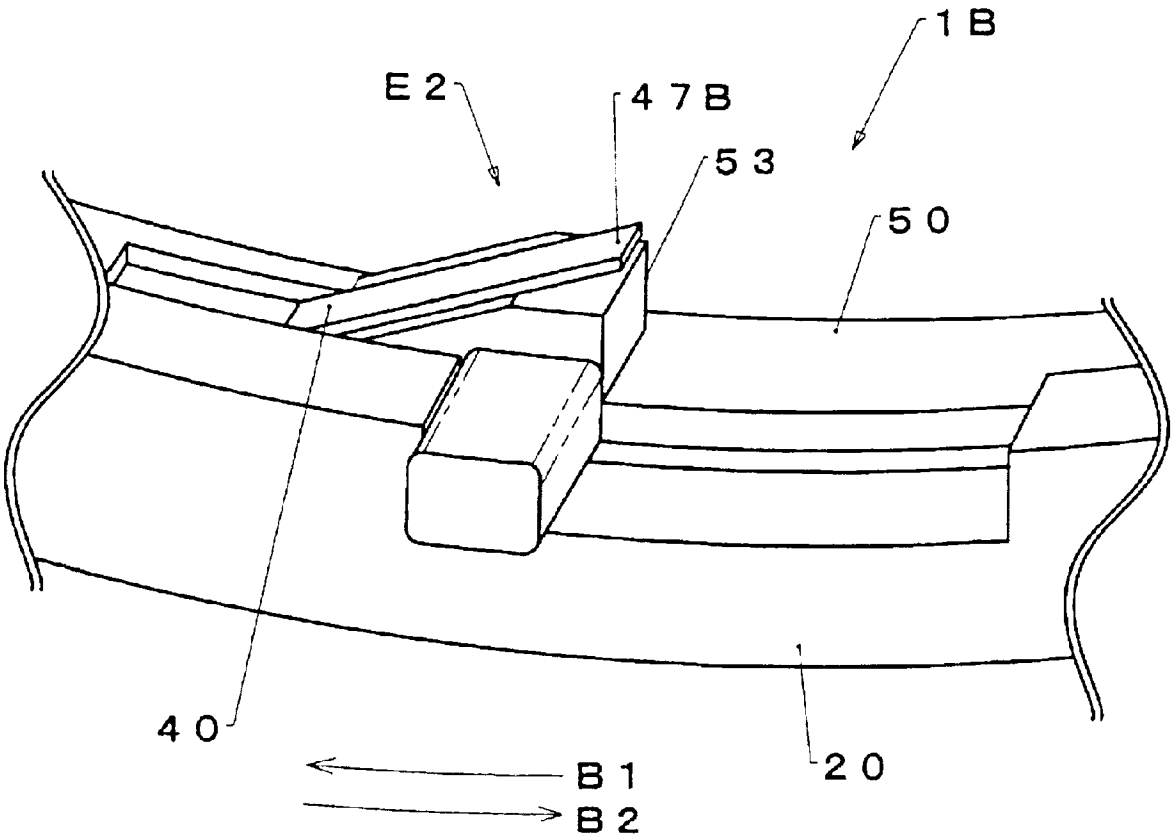

The front end engaging portion of the spring main body portion 43 may be constituted such that instead of being formed to fold to bend relative to the inclined spring portion 46 as shown by FIG. 7A or FIG. 8A, as shown by a rotating type bezel apparatus 1B of FIG. 7B or FIG. 8B, the front end engaging portion is bent to gradually increase the angle of inclination and a front end portion thereof functions as a front end engaging portion 47B. In that case, preferably, the inclined face portion 54 of the stopper main body portion 53 of the stopper 50 includes a bent inclined face 54*a*B instead of the flat inclined face 54*a*. The other point is constituted similar to the case of FIG. 7A and FIG. 8A.

According to the rotating type bezel apparatus 1A or 1B shown in FIG. 7A or FIG. 7B, as respectively shown by FIG. 8A or FIG. 8B, rotation of the bezel 60 in B2 direction can be prohibited by the front end engaging portion 47A or 47B of the click spring 40 supported by the stopper main body portion 53 of the stopper 50 from the back face.

What is claimed is:

1. A rotating-type bezel apparatus comprising:

a case body;

a bezel movably mounted on the case body for rotational movement around a central axis line of the case body, the bezel having a plurality of alternately spaced recesses and projections disposed at regular angular intervals along a peripheral direction of the bezel;

a spring mounted on the case body, the spring having a front end portion disposed at a preselected position relative to the bezel so that during rotational movement of the bezel the front end portion alternately deflects in a first direction and a second direction opposite to the first direction for elastically engaging surface portions of the recesses and projections of the bezel to impart a click feel to the bezel; and a stopper movably mounted on the case body for movement between a first position in which the stopper is disposed in engagement with the spring for holding the front end portion thereof at the preselected position and preventing deflection of the front end portion in the second direction to prevent rotational movement of the bezel and a second position in which the stopper does not engage the spring so that the front end portion thereof alternately deflects in the first and second directions to elastically engage the surface portions of the recesses and projections of the bezel during rotational movement of the bezel.

2. A rotating-type bezel apparatus according to claim 1; wherein the recesses of the bezel and the front end portion of the spring are configured so that when the stopper is disposed at the second position and the front end portion of the spring engages the surface portion of one of the recesses of the bezel, rotation of the bezel is permitted only in a first direction of rotation and a tendency of the bezel to rotate in a second direction of rotation opposite to the first direction of rotation causes the surface portion of the one recess of the bezel to exert a force on the spring so that the front end portion of the spring is bent toward the one recess of the bezel.

3. A rotating-type bezel apparatus according to claim 1; wherein the recesses of the bezel and the front end portion of the spring are configured so that when the stopper is disposed at the second position and the front end portion of the spring engages the surface portion of one of the recesses, rotation of the bezel is permitted in opposite directions of rotation while a force is exerted on the spring tending to push the front end portion of the spring away from the one recess of the bezel.

4. A rotating-type bezel apparatus according to claim 1; wherein when the stopper is disposed at the first position, the stopper supports the front end portion of the spring from a rear surface thereof so that the front end portion of the spring engages the surface portions of one of the recesses and the two projections on either side of the one recess of the bezel; and wherein when the stopper is disposed at the second position, the stopper is positioned at a location remote from the front end portion of the spring to permit the release of the engagement between the front end portion of the spring and the surface portions of the one recess and the two projections on either side of the one recess of the bezel.

5. A rotating-type bezel apparatus according to claim 1; further comprising resistance providing means for providing a resistance to movement of the stopper to and from at least one of the first position and the second position.

6. A rotating-type bezel apparatus according to claim 5; wherein the resistance providing means comprises a projecting portion of the stopper and a recessed portion of the case body for receiving the projecting portion.

7. A rotating-type bezel apparatus according to claim 5; wherein the resistance providing means comprises a projecting portion of the case body and a recessed portion of the stopper for receiving the projecting portion.

8. A rotating-type bezel apparatus according to claim 1; wherein the stopper has a surface for contacting a surface of the spring when the stopper is in the first position.

9. A rotating-type bezel apparatus according to claim 8, wherein the contacting surfaces of the stopper and the spring are disposed generally parallel to one another when the stopper is in the first position.

10. A rotating-type bezel apparatus according to claim 1; wherein the stopper is mounted on the case body for undergoing rotational movement relative to the spring between the first position and the second position.

11. A rotating-type bezel apparatus according to claim 1; wherein the spring comprises a base portion and a main body portion extending from the base portion and having the front end portion; and wherein the stopper has a base portion and an opening extending through the base portion, the base portion of the stopper being disposed over the base portion of the spring so that the main body portion of the spring projects through the opening of the stopper.

12. A portable timepiece having the rotating-type bezel apparatus according to claim 1.

13. A rotating-type bezel apparatus comprising:

a case body;

a bezel rotatably mounted on the case body for rotational movement, the bezel having a plurality of alternately spaced recesses and projections;

a first member mounted on the case body, the first member having a main body with an end portion elastically engageable with surface portions of the recesses and projections of the bezel to impart a click feel to the bezel during rotational movement thereof; and a second member separate and distinct from the first member and movably mounted on the case body for movement between a first position in which the second member engages the first member to prevent a release of an elastic engagement between the end portion of the main body of the first member and the surface portions of one recess and the two projections on either side of the one recess of the bezel and a second position in which the second member does not engage the first member and thereby permits the release of the elastic engagement between the end portion of the main body of the first member and the surface portions of the one recess and the two projections on either side of the one recess of the bezel.

14. A rotating-type bezel apparatus according to claim 13; wherein the second member has a surface for contacting a surface of the first member in the first position of the second member; and wherein the contacting surfaces of the first and second members in the first position of the second member are disposed generally parallel to one another.

15. A rotating-type bezel apparatus according to claim 13; wherein the first member comprises a base portion from which the main body extends; and wherein the second member has a base portion and an opening extending through the base portion, the base portion of the second member being disposed over the base portion of the first member so that the main body of the first member projects through the opening of the second member.

16. A rotating-type bezel apparatus according to claim 15; wherein each of the first and second members is generally ring-shaped.

17. A rotating-type bezel apparatus according to claim 13; wherein the second member is mounted on the case body for undergoing rotational movement relative to the first member between the first and second positions of the second member.

18. A rotating-type bezel apparatus according to claim 13; wherein the case body has a pair of recessed portions; and wherein the second member has a projection for engagement with each of the recessed portions of the case body in the first and second positions, respectively, of the second member.

19. A rotating-type bezel apparatus comprising:

a case body;

a bezel rotatably mounted on the case body for rotational movement, the bezel having a plurality of alternately spaced recesses and projections;

a first member mounted on the case body, the first member having a base portion and a main body portion extending from the base portion for undergoing pivotal movement relative to the base portion in a first direction of rotation toward the recesses and projections of the bezel and in a second direction of rotation opposite to the first direction of rotation, the main body portion having an end portion elastically engageable with surface portions of the recesses and projections of the bezel while the main body portion undergoes pivotal movement in the first and second directions of rotations to impart a click feel to the bezel during rotational movement thereof; and a second member movably mounted on the case body for movement between a first position in which the second member engages the first member to prevent pivotal movement of the main body portion of the first member in the second direction of rotation and a second position in which the second member does not engage the first member and thereby permits pivotal movement of the main body portion of the first member in the second direction of rotation.

20. A rotating-type bezel apparatus according to claim 19; wherein the case body has a pair of recessed portions; and wherein the second member has a projection for engagement with each of the recessed portions of the case body in the first and second positions, respectively, of the second member.

* * * * *